United States Patent [19]

Wismer

[11] 4,176,039

[45] Nov. 27, 1979

[54] ELECTROPLATING RACK

[76] Inventor: Joseph C. Wismer, 10 Sussex Rd., Bergenfield, N.J. 07621

[21] Appl. No.: 16,806

[22] Filed: Mar. 2, 1979

[51] Int. Cl.[2] ..... C25D 17/06; C25D 17/08; H01R 7/08

[52] U.S. Cl. ..... 204/297 W; 204/279; 339/263 E

[58] Field of Search ..... 204/279, 297 W, 297 R; 339/263 E

[56] References Cited

U.S. PATENT DOCUMENTS 2,820,757 1/1958 Belke ..... 204/297 W 3,671,416 6/1972 Belke ..... 204/297 W

*Primary Examiner*—Howard S. Williams

*Attorney, Agent, or Firm*—Samuelson & Jacob

[57] ABSTRACT

An electroplating rack upon which an item to be plated is secured for immersion in a plating solution and in which electrical contact is made between the rack and the item by a clamp having a clamp screw and an opposed clamp pad, both the clamp screw and the clamp pad having a structure which provides the appropriate clamping forces and electrical connections while establishing seals for isolating the electrically conductive elements of the clamp from the plating solution.

38 Claims, 5 Drawing Figures

ELECTROPLATING RACK

The present invention relates generally to electroplating apparatus and pertains, more specifically, to a rack for securing and immersing in a plating solution items which are to be electroplated.

In the electroplating of various items, such as circuit boards, tools, utensils and a wide variety of decorative and utilitarian components, the items to be plated commonly are secured upon a rack which is immersed, together with the items, within a plating solution. The rack generally carries a plurality of clamps which not only hold the items in place, but make the appropriate electrical connection to each item. In order to preclude unwanted plating of the component parts of the rack and the clamps, an insulating structure is employed to isolate the various electrically conductive component parts of the rack and the clamps from the plating solution.

It is an object of the present invention to provide an improved insulating structure for isolating from the plating solution the various electrically conductive components of the clamps employed in the rack.

Another object of the invention is to provide a clamp construction which includes a clamp screw and an opposed clamp pad, both of which provide the appropriate clamping forces and the necessary electrical connections while establishing seals for isolating the electrically conductive elements of the clamp from the plating solution.

Still another object of the invention is to provide a clamp construction of the type described and in which the clamp screw has a composite structure employing selected materials at specific locations for accomplishing the desired clamping and sealing functions.

Yet another object of the invention is to provide a clamp construction of the type described and in which the clamp pad has a composite structure employing selected materials at specific locations for accomplishing the desired clamping and sealing functions.

A further object of the invention is to provide an electroplating rack clamp construction which is easy to use and which will provide reliable service over an extended period of use, with reduced maintenance costs.

A still further object of the invention is to provide an electroplating rack of high quality which is economically fabricated of readily available materials.

The above objects, as well as still further objects and advantages, are attained by the present invention which may be described briefly as providing, in an electroplating rack in which an item to be plated in secured upon the rack for immersion in a plating solution and electrical contact is made between the rack and the item, a clamp for securing and electrically connecting the item to the rack, the clamp comprising: a clamp frame including a core of conductive material connected to the rack and a sheath of resilient insulating material covering the core; a threaded opening in the clamp frame, the threaded opening including a first threaded portion extending through the core and having opposite ends, a second threaded portion extending from one of the opposite ends through a corresponding portion of the sheath, and a third threaded portion extending from the other of the opposite ends through a further corresponding portion of the sheath; a clamp screw having an actuating head, a clamp face and a threaded shank extending axially between the actuating head and the clamp face for reception within the threaded opening, the threaded shank including a first threaded portion of electrically conductive material for engaging the first threaded portion of the threaded opening and making electrical contact therewith, a second threaded portion of resilient insulating material extending axially between the first threaded portion of the threaded shank and the head for engaging the second threaded portion of the threaded opening, the relative dimensions and the relative resilience of the second threaded portion of the threaded shank and the second threaded portion of the threaded opening being such that a first seal is established upon engagement of the second threaded portions, a third threaded portion of resilient insulating material extending between the first threaded portion of the threaded shank and the clamp face of engaging the third threaded portion of the threaded opening, the relative dimensions and the relative resilience of the third threaded portion of the threaded shank and the third threaded portion of the threaded opening being such that a second seal is established upon engagement of said third threaded portions, whereby the first and second seals effectively isolate the engaged first threaded portions from the plating solution; the clamp face including a conductive surface for engaging the item; conductive means interconnecting the conductive surface with the first threaded portion of the threaded shank; and a clamp pad on the clamp frame opposite the threaded opening for enabling the item to be clamped between the clamp screw and the clamp pad.

The invention will be more fully understood, while still further objects and advantages thereof will become apparent, in the following detailed description of a preferred embodiment thereof illustrated in the accompanying drawing, in which.

Figure 1:
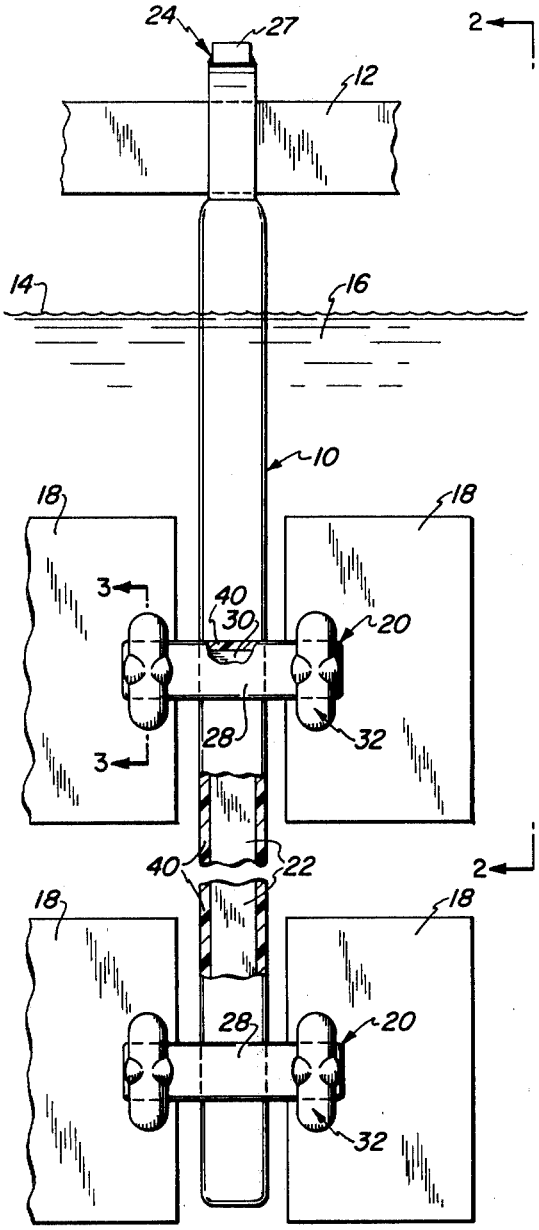
FIG. 1 is a front elevational view of an electroplating rack constructed in accordance with the invention.
Figure 2:
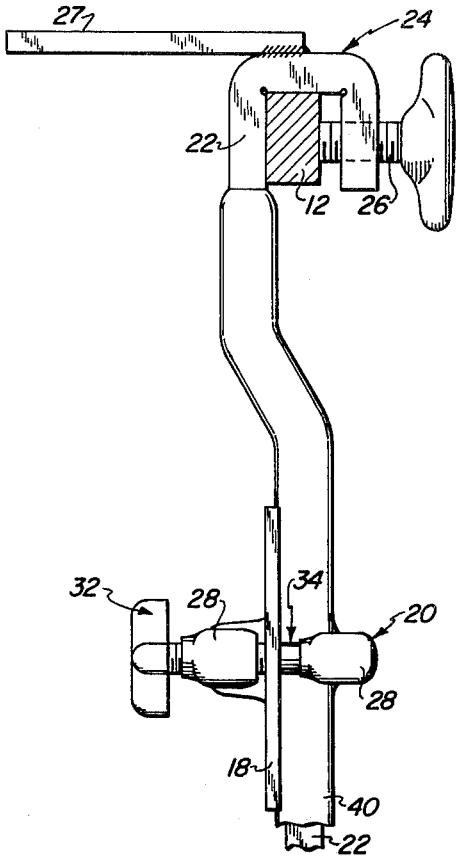
FIG. 2 is a fragmentary side elevational view of the rack, taken in the direction of the arrow in FIG. 1.

Referring now to the drawing, and especially to FIGS. 1 and 2 thereof, an electroplating rack constructed in accordance with the invention is shown at 10. Rack 10 is seen suspended from a crossbar 12 and extending downwardly into a bath 14 of plating solution 16. Items shown in the form of circuit boards 18 are secured to rack 10 by clamps 20 and are immersed in the plating solution 16.

Rack 10 includes an elongate rod 22 of electrically conductive material, preferably a highly corrosion-resistant metal of adequate conductivity such as stainless steel, having a clamping arrangement 24 at the top end thereof with a thumb screw 26 for attaching the rack 10 to the crossbar 12. A handgrip 27 is provided at the top end of the rod 22 to enable handling of the rack 10. Clamps 20 are located at longitudinally spaced locations along the rod 22 and each clamp 20 includes a clamp frame 28 having a conductive core 30 connected mechanically and electrically to the conductive rod 22 of the rack 10. Clamp frames 28 each carry at least one clamp screw 32 and a clamp pad 34 opposite each clamp screw 32 so that a circuit board 18 can be clamped between a clamp screw 32 and a clamp pad 34 to secure the circuit board 18 to the rack 10.

Figure 3:
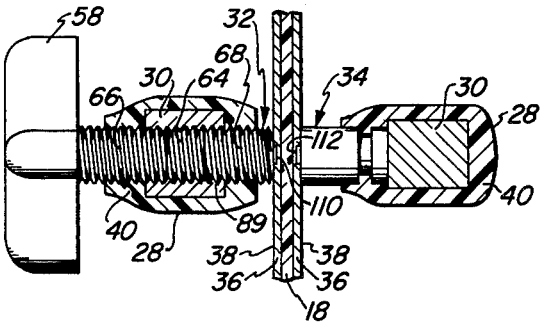
FIG. 3 is an enlarged cross-sectional view taken along line 3—3 of FIG. 1.

As best seen in FIG. 3, each circuit board 18 has a sheet 36 of conductive material, such as copper, at each of the opposite faces 38 of the circuit board 18 and each sheet 36 is to be plated in bath 14. Thus, an electrical connection must be made between each of the sheets 36 and the source of plating current. The appropriate connection is made by electrical contact means in the clamp screw 32 and in the clamp pad 34 which electrically connect the sheets 36 with core 30 and hence with rod 22 and crossbar 12, as will be described in greater detail below.

In order to preclude plating of the rod 22 and cores 30 of clamp frames 28, rod 22 and cores 30 are covered with a sheath 40 of insulating material. Sheath 40 preferably is in the form of a resilient synthetic resin material such as a plastisol which can be applied readily by dipping the assembled rod 22 and cores 30 in the uncured plastisol to coat the rod 22 and cores 30 and establish a sheath 40 which is impervious to the plating solution 16. Plating of the clamp screws 32 and the clamp pads 34 also is precluded by providing an insulating structure, but the insulating structure is so constructed as to enable each clamp 20 to secure and electrically connect a corresponding circuit board 18 to rack 10, as now will be explained.

Figure 4:
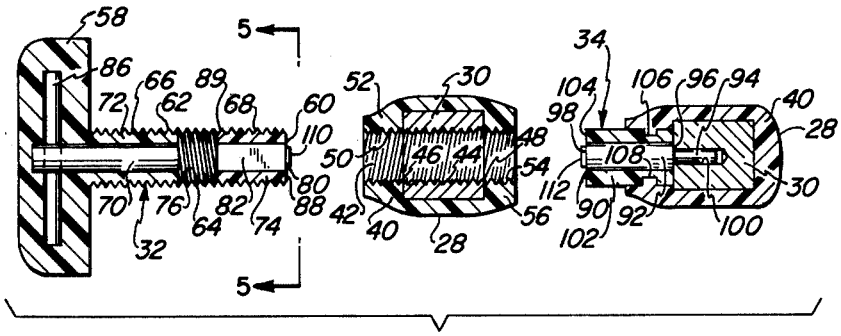
FIG. 4 is an exploded cross-sectional view of certain component parts of FIG. 3.
Figure 5:
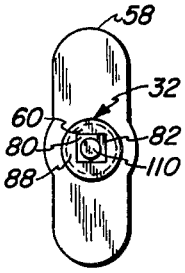
FIG. 5 is an end view taken along line 5—5 of FIG. 4.

Turning now to FIGS. 3 through 5, as well as to FIGS. 1 and 2, each clamp frame 28 has a threaded opening 42 extending axially through the clamp frame 28 and including a first threaded portion 44 extending between opposite ends 46 and 48 through core 30, a second threaded portion 50 extending from end 46 through a corresponding portion 52 of the sheath 40 and a third threaded portion 54 extending from end 48 through a further corresponding portion 56 of sheath 40. Each clamp screw 32 has an actuating head in the form of actuating handle 58, a clamp face 60 and a threaded shank 62 extending axially between the handle 58 and the clamp face 60.

As best seen in FIG. 4, the threaded shank 62 of clamp screw 32 is divided into a first threaded portion 64, a second threaded portion 66 and a third threaded portion 68. Clamp screw 32 preferably is constructed with a central member 70 of electrically conductive material having high strength and corrosion resistance, such as stainless steel, a first sleeve 72 of resilient synthetic resin material, and a second sleeve 74 of resilient synthetic resin material, sleeves 72 and 74 being carried by the central member 70. Central member 70 includes a unitary threaded collar 76 which carries first threaded portion 64. When clamp screw 32 is received within threaded opening 42, first threaded portion 64 of shank 62 engages first threaded portion 44 of opening 42 so that an electrical connection is made between central member 70 and core 30. Electrical continuity is continued to a conductive surface 80 of clamp face 60 through an axial portion 82 of central member 70.

In order to isolate the interconnected conductive portions 44 and 64 from the plating solution 16, seals are provided adjacent the ends 46 and 48 of the first threaded portion 44. Thus, sleeve 72 is constructed of a resilient synthetic resin material, such as a plastisol, having a durometer which is greater than the durometer of the material of sheath 40. The relative dimensions and the relative resilience of the second threaded portion 50 of the threaded opening 42 and the second threaded portion 66 of shank 62 are such that upon engagement of the second threaded portions 50 and 66, as seen in FIG. 3, a seal will be established between the second threaded portions to preclude entry of the plating solution 16. Thus, the relative diameters and resilience of the second threaded portions 50 and 66 are such that the second threaded portion 50 of the opening 42 will be dilated slightly to grip the corresponding second threaded portion 66 of the shank 62 in a sealing relationship which will preclude entry of the plating solution 16. A preferred material for sheath 40 is a plastisol sold under the designation UNICHROME Compound 218X by M & T Chemicals Inc. of Rahway, N.J., and having a durometer of about 68 to 74 (Shore A scale). The material for sleeve 72 is then chosen for its greater durometer of about 90 (Shore A scale). A suitable material for sleeve 72 is a plastisol supplied under the designation Compound XL 4517 by M & T Chemicals Inc. Preferably, central member 70 is provided with a handle portion in the form of a laterally extending pin 86 and actuating handle 58 is molded unitary with sleeve 72 and is of the same material. Thus, handle 58 is non-conductive and will not be plated.

Second sleeve 74 extends axially from threaded collar 76 to the clamp face 60 and carries third threaded portion 68 of the shank 62. Upon engagement of the shank 62 with opening 42, third threaded portions 54 and 68 will establish a seal by virtue of the relative dimensions and relative resilience of the third threaded portions 54 and 68. Thus, the relative diameters and resilience of the third threaded portions 54 and 68 are such that the third threaded portion 54 of opening 42 will be dilated to grip the corresponding third threaded portion 68 of the shank 62 in a sealing relationship which will preclude entry of the plating solution 16.

In addition to the axial seal provided along the engaged third threaded portions 54 and 68, a radial end seal is provided for isolating the conductive surface 80 of the clamp face 60 from the plating solution 16. To this end, sleeve 74 extends to clamp face 60 and provides an insulating clamping surface 88 surrounding the conductive surface 80, as seen in FIG. 5. When clamp face 60 is urged against the circuit board 18, clamping surface 88 not only serves to clamp the circuit board 18 in place, but the resilience of the material of sleeve 74 establishes a radial seal along the clamping surface 88, which seal isolates conductive surface 80 from the plating solution 16. In order to attain the desired axial and radial seals along the third threaded portion 68 and the clamping surface 88, the material of sleeve 74 must be resilient, but a certain degree of renitence is required in order to attain the appropriate clamping forces at the clamping surface. Fluorocarbon synthetic resins possess the necessary balance between resilience and renitence and tetrafluoroethylene is a preferred material for sleeve 74. Further, tetrafluoroethylene has been found to be sufficiently heat resistant and highly resistant to plating over an exceptionally long service life. Sleeve 74 is coupled for rotation with axial portion 82 of central member 70 by virtue of the square cross-sectional configuration of axial portion 82. In order to assure that sleeve 74 remains properly seated upon axial portion 82 of central member 70, at least one to two threads of sleeve 74 at 89 will always remain engaged with first threaded portion 44 in core 30 when the clamp screw 32 is in use.

Each clamp pad 34 also includes a provision for making an electrical connection between the circuit board 18 and the core 30 of the clamp frame 28. Each clamp pad 34 provides a clamp face 90 opposite the clamp face 60 of a corresponding clamp screw 32. A further central member is shown in the form of an electrically conductive pin 92, preferably of a metal, such as stainless steel, having a projection 94 extending axially from a shoulder 96 toward the inner end of the pin. The outer end of pin 92 is located at the clamp face 90 and provides a conductive surface 98. Pin 92 is seated and secured within a hole 100 in core 30 and conductive surface 98 is located accurately relative to core 30 by means of the shoulder 96 resting against the core 30. A further sleeve 102 of synthetic resin material is placed upon pin 92 and extends from core 30 to the clamp face 90. Sleeve 102 surrounds pin 92 and provides an insulating clamping surface 104 around the conductive surface 98. When clamp face 90 is urged against the circuit board 18, clamping surface 104 not only serves to clamp the circuit board 18 in place, but the resilience of the material of sleeve 102 establishes a radial seal along the clamping surface 104, which seal isolates conductive surface 98 from the plating solution 16. Sleeve 102 preferably is constructed of a fluorocarbon synthetic resin, such as tetrafluoroethylene, to attain the appropriate balance between resilience and renitence desired for the development of the desired sealing and clamping forces along clamping surface 104. Again, tetrafluoroethylene has been found to be sufficiently heat resistant and highly resistant to plating over an exceptionally long service life.

Sheath 40 extends axially at least partially along sleeve 102 to establish a seal which will isolate the core 30 from plating solution 16. In order to enhance that seal, sleeve 102 is provided with a lateral groove 106 extending circumferentially around sleeve 102 and sheath 40 extends into the groove 106 to establish an integral sealing ring 108 for maintaining the integrity of the seal.

In order to assure that a good electrical connection is made between the conductive surface 80 of the clamp screw 32 and the corresponding sheet 36 of circuit board 18, at least a portion of the conductive surface 80, shown in the form of a boss 110, is extended axially a very short distance beyond the surrounding clamping surface 88.

Thus, boss 110 will engage and become embedded slightly in sheet 36 to establish good electrical contact before the renitence of sleeve 74 will tend to reduce the contact pressure at conductive surface 80. Likewise, a boss 112 is provided at the conductive surface 98 of clamp pad 34 and extends axially slightly beyond clamping surface 104 to establish good electrical contact with corresponding sheet 36 of circuit board 18 before the renitence of sleeve 102 will tend to reduce the contact pressure. Shoulder 96 keeps the conductive surface 98 and boss 112 located accurately relative to clamping surface 104. Furthermore, a mechanical interlock is established between ring 108 and groove 106 to further secure sleeve 102 in place upon pin 92.

An external source of plating current is connected to rack 10 through crossbar 12. A complete electrical circuit is provided to all of the items to be plated, as described above. However, plating solution 16 is excluded from all conductive elements of the rack, thereby facilitating more economical plating operations and enhancing the service life and maintenance of electroplating racks.

It is to be understood that the above detailed description of an embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. In an electroplating rack in which an item to be plated is secured upon the rack for immersion in a plating solution and electrical contact is made between the rack and the item, a clamp for securing and electrically connecting the item to the rack, said clamp comprising:

a clamp frame including a core of conductive material connected to the rack and a sheath of resilient insulating material covering the core;

a threaded opening in the clamp frame, the threaded opening including a first threaded portion extending through the core and having opposite ends, a second threaded portion extending from one of the opposite ends through a corresponding portion of the sheath and a third threaded portion extending from the other of the opposite ends through a further corresponding portion of the sheath;

a clamp screw having an actuating head, a clamp face and a threaded shank extending axially between the actuating head and the clamp face for reception within the threaded opening, the threaded shank including a first threaded portion of electrically conductive material for engaging the first threaded portion of the threaded opening and making electrical contact therewith, a second threaded portion of resilient insulating material extending axially between the first threaded portion of the threaded shank and the head for engaging the second threaded portion of the threaded opening, the relative dimensions and the relative resilience of the second threaded portion of the threaded shank and the second threaded portion of the threaded opening being such that a first seal is established upon engagement of said second threaded portions, a third threaded portion of resilient insulating material extending between the first threaded portion of the threaded shank and the clamp face for engaging the third threaded portion of the threaded opening, the relative dimensions and the relative resilience of the third threaded portion of the threaded shank and the third threaded portion of the threaded opening being such that a second seal is established upon engagement of said third threaded portions, whereby the first and second seals effectively isolate the engaged first threaded portions from the plating solution;

the clamp face including a conductive surface for engaging the item;

conductive means interconnecting the conductive surface with the first threaded portion of the threaded shank; and a clamp pad on the clamp frame opposite the threaded opening for enabling the item to be clamped between the clamp screw and the clamp pad.

2. The invention of claim 1 wherein the material of the sheath is an insulating synthetic resin material of a first durometer and the material of the second threaded portion is a synthetic resin material of a second durometer greater than the first durometer.

3. The invention of claim 2 wherein the first durometer is about 68 to 74 and the second durometer is about 90.

4. The invention of claim 1, 2 or 3 wherein the head of the clamp screw includes an actuating handle of resilient insulating material molded unitary with the second threaded portion of the threaded shank.

5. The invention of claim 1 wherein the insulating material of the third threaded portion of the shank extends axially to the clamp face and includes a clamping surface surrounding the conductive surface.

6. The invention of claim 5 wherein the material of the sheath is a plastisol and the material of the third threaded portion of the shank is a fluorocarbon synthetic resin material, the material of the third threaded portion of the shank having sufficient renitence to engage and aid in securing the item within the clamp while establishing a seal around the conductive surface to isolate the conductive surface from the plating solution.

7. The invention of claim 5 wherein the material of the third threaded portion is tetrafluoroethylene.

8. The invention of claim 5, 6 or 7 wherein a limited portion of the conductive surface extends axially slightly beyond the surrounding clamping surface.

9. The invention of claim 1 wherein the clamp screw includes:

a central member of metal extending between the clamp face and the actuating head, the first threaded portion of the threaded shank being unitary with the central member, and the conductive means being an axial portion of the central member;

a first sleeve of resilient insulating material extending axially along the central member between the first threaded portion of the threaded shank and the actuating head, said first sleeve carrying the second threaded portion of the threaded shank; and a second sleeve of resilient insulating material extending axially along the axial portion of the central member between the first threaded portion of the threaded shank and the clamp face.

10. The invention of claim 9 wherein the material of the sheath is an insulating synthetic resin material of a first durometer and the material of the first sleeve is a synthetic resin material of a second durometer greater than the first durometer.

11. The invention of claim 10 wherein the material of the sheath is a plastisol having a durometer of about 68 to 74 and the material of the first sleeve is a plastisol having a durometer of about 90.

12. The invention of claim 9, 10 or 11 wherein:

the head of the clamp screw includes a laterally extending actuating handle of resilient insulating material molded unitary with the first sleeve; and the central member includes a handle portion extending laterally within the actuating handle.

13. The invention of claim 9 wherein the second sleeve of resilient material extends axially to the clamp face and includes a clamping surface surrounding the conductive surface.

14. The invention of claim 13 wherein the material of the sheath is a plastisol and the material of the second sleeve is a fluorocarbon synthetic resin material, the material of the second sleeve having sufficient renitence to engage and aid in securing the item within the clamp while establishing a seal around the conductive surface to isolate the conductive surface from the plating solution.

15. The invention of claim 14 wherein the material of the second sleeve is tetrafluoroethylene.

16. The invention of claim 13, 14 or 15 wherein a limited portion of the conductive surface extends axially slightly beyond the surrounding clamping surface.

17. The invention of claim 1 wherein the clamp pad includes:

a further clamp face opposite the clamp face of the clamp screw, the further clamp face including a further conductive surface for engaging the item; and further conductive means interconnecting the further conductive surface with the core of the clamp frame.

18. The invention of claim 17 wherein the clamp pad includes:

a further sleeve of insulating synthetic resin material having opposite ends and extending axially between the core of the clamp frame and the further conductive surface;

a lateral groove in the further sleeve, the groove extending around the perimeter of the further sleeve adjacent the end of the sleeve which is juxtaposed with the core of the clamp frame;

the sheath extending along the further sleeve and into the groove to establish a seal for isolating the juxtaposed end of the further sleeve and the corresponding portion of the core from the plating solution.

19. The invention of claim 18 wherein the clamp pad includes:

a further central member of metal extending axially between the core and the further clamp face, the further conductive means being an axial portion of the further central member; and the further sleeve extends axially along the further central member to the further clamp face and includes a further clamping surface surrounding the further conductive member.

20. The invention of claim 19 wherein the material of the sheath is a plastisol and the material of the further sleeve is a fluorocarbon synthetic resin, the material of the further sleeve having sufficient renitence to engage and aid in securing the item within the clamp while establishing a seal around the further conductive surface to isolate the further conductive surface from the plating solution.

21. The invention of claim 20 wherein the material of the further sleeve is tetrafluoroethylene.

22. The invention of claim 19, 20 or 21 wherein at least a limited portion of the further conductive surface extends axially slightly beyond the surrounding further clamping surface.

23. The invention of claim 19, 20 or 21 wherein the further central member includes a shoulder adjacent the end which is juxtaposed with the core for abutting the core to locate the further central member accurately relative to the core.

24. A clamp screw for use in an electroplating rack in which an item to be plated is secured upon the rack for immersion in a plating solution and electrical contact is made between the rack and the item, the rack including at least one clamp for securing and electrically connecting the item to the rack, and the clamp having a clamp frame including a core of electrically conductive material connected to the rack, a sheath of resilient insulating material covering the core, and a threaded opening in the clamp frame, the threaded opening including a first threaded portion extending through the core and having opposite ends, a second threaded portion extending from one of the opposite ends through a corresponding portion of the sheath and a third threaded portion extending from the other of the opposite ends through a further corresponding portion of the sheath, said clamp screw comprising:

an actuating head;

a clamp face; and a threaded shank extending axially between the actuating head and the clamp face for reception within the threaded opening of the clamp, the threaded shank including a first threaded portion of electrically conductive material for engaging the first threaded portion of the threaded opening and making electrical contact therewith, a second threaded portion of resilient insulating material extending axially between the first threaded portion of the shank and the actuating head for engaging the second threaded portion of the threaded opening, the relative dimensions and the relative resilience of the second threaded portion of the threaded shank and the second threaded portion of the threaded opening being such that a first seal will be established upon engagement of said second threaded portions, a third threaded portion of resilient insulating material extending between the first threaded portion of the threaded shank and the clamp face for engaging the third threaded portion of the threaded opening, the relative dimensions and the relative resilience of the third threaded portion of the threaded shank and the third threaded portion of the threaded opening being such that a second seal will be established upon engagement of said third threaded portions, whereby the first and second seals effectively will isolate the engaged first threaded portions from the plating solution;

the clamp face including a conductive surface for engaging the item; and conductive means interconnecting the conductive surface with the first threaded portion of the threaded shank.

25. The invention of claim 24 wherein the clamp screw includes:

a central member of metal extending between the clamp face and the actuating head, the first threaded portion of the threaded shank being unitary with the central member, and the conductive means being an axial portion of the central member;

a first sleeve of resilient insulating material extending axially along the central member between the first threaded portion of the threaded shank and the actuating head, said first sleeve carrying the second threaded portion of the threaded shank; and a second sleeve of resilient insulating material extending axially along the axial portion of the central member between the first threaded portion of the threaded shank and the clamp face.

26. The invention of claim 25 wherein the material of the sheath is an insulating synthetic resin material of a first durometer and the material of the first sleeve is a synthetic resin material of a second durometer greater than the first durometer.

27. The invention of claim 26 wherein the material of the sheath is a plastisol having a durometer of about 68 to 74 and the material of the first sleeve is a plastisol having a durometer of about 90.

28. The invention of claim 25, 26 or 27 wherein:

the head of the clamp screw includes a laterally extending actuating handle of resilient insulating material molded unitary with the first sleeve; and the central member includes a handle portion extending laterally within the actuating handle.

29. The invention of claim 25 wherein the second sleeve of resilient material extends axially to the clamp face and includes a clamping surface surrounding the conductive surface.

30. The invention of claim 29 wherein the material of the sheath is a plastisol and the material of the second sleeve is a fluorocarbon synthetic resin material, the material of the second sleeve having sufficient renitence to engage and aid in securing the item within the clamp while establishing a seal around the conductive surface to isolate the conductive surface from the plating solution.

31. The invention of claim 30 wherein the material of the second sleeve is tetrafluoroethylene.

32. The invention of claim 29, 30 or 31 wherein a limited portion of the conductive surface extends axially slightly beyond the surrounding clamping surface.

33. A clamp pad for use in an electroplating rack in which an item to be plated is secured upon the rack for immersion in a plating solution and electrical contact is made between the rack and the item, the rack including at least one clamp for securing and electrically connecting the item to the rack, and the clamp having a clamp frame including a core of conductive material connected to the rack, a sheath of resilient insulating material covering the core, and a clamp face, said clamp pad comprising:

a further clamp face opposite the clamp face of the clamp frame for enabling the item to be clamped between the clamp faces, the further clamp face including a conductive surface for engaging the item;

conductive means interconnecting the conductive surface with the core of the clamp frame;

a sleeve of insulating synthetic resin material having opposite ends and extending axially between the core of the clamp frame and the conductive surface; and a groove in the sleeve, the groove extending around the perimeter of the sleeve adjacent the end of the sleeve which is juxtaposed with the core of the clamp frame;

the sheath extending along the sleeve and into the groove to establish a seal for isolating the juxtaposed end of the sleeve and the corresponding portion of the core from the plating solution.

34. The invention of claim 33 wherein the clamp pad includes:

a central member of metal extending axially between the core and the further clamp face, the conductive means being an axial portion of the central member; and the sleeve extends axially along the central member to the further clamp face and includes a clamping surface surrounding the conductive member.

35. The invention of claim 34 wherein the material of the sheath is a plastisol and the material of the sleeve is a fluorocarbon synthetic resin, the material of the sleeve having sufficient renitence to engage and aid in securing the item within the clamp while establishing a seal around the conductive surface to isolate the conductive surface from the plating solution.

36. The invention of claim 35 wherein the material of the sleeve is tetrafluoroethylene.

37. The invention of claim 34, 35 or 36 wherein at least a limited portion of the conductive surface extends axially slightly beyond the surrounding clamping surface.

38. The invention of claim 34, 35 or 36 wherein the central member includes a shoulder adjacent the end which is juxtaposed with the core for abutting the core to locate the central member accurately relative to the core.

* * * * *